US008439169B2

(12) United States Patent
Iio et al.

(10) Patent No.: US 8,439,169 B2
(45) Date of Patent: May 14, 2013

(54) ELEVATOR GROUP SUPERVISION CONTROLLING APPARATUS

(75) Inventors: Mitsutoshi Iio, Aichi (JP); Shiro Hikita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 356 days.

(21) Appl. No.: 13/001,136

(22) PCT Filed: Aug. 25, 2008

(86) PCT No.: PCT/JP2008/065103

§ 371 (c)(1),
(2), (4) Date: Dec. 23, 2010

(87) PCT Pub. No.: WO2010/023719

PCT Pub. Date: Mar. 4, 2010

(65) Prior Publication Data

US 2011/0127114 A1 Jun. 2, 2011

(51) Int. Cl.
*B66B 1/18* (2006.01)

(52) U.S. Cl.
USPC ..... 187/387; 187/391

(58) Field of Classification Search ..... 187/247, 187/380–388, 391–393
See application file for complete search history.

(56) References Cited

U.S. PATENT DOCUMENTS 5,146,053 A * 9/1992 Powell et al. ..... 187/388
6,986,408 B2 * 1/2006 Takeuchi ..... 187/380
7,328,775 B2 * 2/2008 Zaharia et al. ..... 187/396
7,581,622 B2 * 9/2009 Amano ..... 187/384
7,712,586 B2 * 5/2010 Legez ..... 187/391

(Continued)

FOREIGN PATENT DOCUMENTS

JP 8 198532 8/1996
JP 3040524 3/2000

(Continued)

OTHER PUBLICATIONS

International Search Report issued Apr. 7, 2009 in PCT/JP08/65103 filed Aug. 25, 2008.

*Primary Examiner* — Anthony Salata
(74) *Attorney, Agent, or Firm* — Oblon, Spivak, McClelland, Maier & Neustadt, L.L.P.

(57) ABSTRACT

An elevator group supervision controlling apparatus has a response time predicting means, a passenger movement estimating means, a standby time predicting means, a candidate car selecting means, an allocating means, and an instructing means. The response time predicting means predicts response time to a car call from a remote call registering apparatus for respective cars. The passenger movement estimating means estimates passenger moving time based on a positional relationship between the remote call registering apparatus and a landing. The standby time predicting means predicts the standby times of each of the cars based on the response time and the passenger moving time. The candidate car selecting means includes cars for which standby time is shorter than a predetermined time interval in candidate cars, and excludes cars for which standby time is greater than or equal to the predetermined time interval from the candidate cars. The allocating means decides an allocated car from among the candidate cars if at least one of the cars has been included in the candidate cars. The instructing means generates an informing instruction to communicate to the remote call registering apparatus reinput requesting information that recommends an input operation at the landing call registering apparatus if all of the cars are excluded from the candidate cars.

4 Claims, 5 Drawing Sheets

U.S. PATENT DOCUMENTS

| | | | | |
|---|---|---|---|---|
| 7,717,238 | B2 * | 5/2010 | Hamaji et al. | 187/396 |
| 7,849,974 | B2 * | 12/2010 | Stanley et al. | 187/387 |
| 7,918,321 | B2 * | 4/2011 | Sakurai | 187/382 |
| 8,028,806 | B2 * | 10/2011 | Stanley et al. | 187/387 |
| 8,276,715 | B2 * | 10/2012 | Smith et al. | 187/382 |
| 2013/0001021 | A1 * | 1/2013 | Stanley et al. | 187/382 |

FOREIGN PATENT DOCUMENTS

| | | |
|---|---|---|
| JP | 2003 192244 | 7/2003 |
| JP | 2007 191263 | 8/2007 |
| WO | 2006 114877 | 11/2006 |
| WO | 2007 096947 | 8/2007 |

* cited by examiner

ELEVATOR GROUP SUPERVISION CONTROLLING APPARATUS

TECHNICAL FIELD

The present invention relates to an elevator group supervision controlling apparatus that supervises a plurality of elevator apparatuses as a group.

BACKGROUND ART

Conventionally, elevator group supervision controlling apparatuses are known that supervise operation of a plurality of elevators based on information from a common call registering apparatus. In conventional elevators of this kind, the call registering apparatuses may be disposed at positions that are distant from elevator landings such as in landing entrances, or building lobbies, etc., for example. In that case, there is a risk that passengers may miss elevator cars because the position of the elevator doorway is distant from the position of the call registering apparatus.

Conventionally, in order to prevent passengers missing the elevators, elevator group controlling apparatuses have been proposed that compare passenger moving time that is required for a passenger to move from the call registering apparatus to the elevator doorway and running time required before the car arrives at the landing, and control each of the elevators based on the compared result. In conventional elevator group controlling apparatuses, a car for which a predetermined evaluation function value is optimal among the cars for which running time required is longer than passenger moving time is allocated as the car that responds to the call. Cars for which running time required is shorter than passenger moving time are excluded as candidates for allocation (See Patent Literature 1).

Conventionally, in order to prevent passengers missing the elevators, elevator group supervision controlling apparatuses have also been proposed that determine which car to allocate by finding a time difference between the running time required and the passenger moving time, designating substantive waiting time as a time difference when the running time required is longer than the passenger moving time, designating lost time as a time difference when the running time required is shorter than the passenger moving time, and generally evaluating the substantive waiting time and the lost time. In conventional elevator group supervision controlling apparatuses, the elevator doorway is kept in an open state until the passenger moving time elapses (See Patent Literature 2).

[Patent Literature 1]

Japanese Patent No. 3040524 (Gazette)

[Patent Literature 2]

WO 2006/114877

DISCLOSURE OF THE INVENTION

Problem to be Solved by the Invention

However, in the elevator group controlling apparatus that is disclosed in Patent Literature 1, if the running time required by all of the cars is shorter than the passenger moving time, then all of the cars are excluded from being candidates for allocation, and it becomes impossible to determine which car to allocate. Even if a candidate for allocation exists, if the running time required by the car is extremely long, a long time will be required before the car arrives at the landing, making transporting efficiency deteriorate significantly.

In the elevator group supervision controlling apparatus that is disclosed in Patent Literature 2, depending on the relationship between the running time required by the car and the passenger moving time, there is a risk that the doors of the elevator doorway may remain in an open state for a long time even after the passenger has boarded the car.

The present invention aims to solve the above problems and an object of the present invention is to provide an elevator group supervision controlling apparatus that can prevent passengers missing an elevator, and that can also achieve improvements in transporting efficiency.

Means for Solving the Problem

In order to achieve the above object, according to one aspect of the present invention, there is provided an elevator group supervision controlling apparatus that supervises a plurality of elevator apparatuses as a group based on respective information from: a landing call registering apparatus that is disposed on a landing; and a remote call registering apparatus that is disposed at a position that is distant from the landing, the elevator group supervision controlling apparatus being characterized in including: a response time predicting means that predicts respective response times for cars of each of the elevator apparatuses to a car call that the remote call registering apparatus generates on receiving a predetermined input operation; a passenger movement estimating means that estimates passenger moving time for a passenger to reach the landing from the remote call registering apparatus based on a positional relationship between the remote call registering apparatus and the landing; a standby time predicting means that predicts respective standby times at the landing for each of the cars based on the response times and the passenger moving time; a candidate car selecting means that includes a car for which the standby time is shorter than a predetermined time interval in candidate cars, and excludes a car for which the standby time is greater than or equal to the predetermined time interval from the candidate cars; an allocating means that decides a car from among the candidate cars as an allocated car that responds to the car call if at least one of the cars has been included in the candidate cars; and an instructing means that generates an informing instruction that communicates to the remote call registering apparatus reinput requesting information that recommends an input operation at the landing call registering apparatus if all of the cars have been excluded from the candidate cars.

BEST MODE FOR CARRYING OUT THE INVENTION

Preferred embodiments of the present invention will now be explained with reference to the drawings.

Embodiment 1

Figure 1:
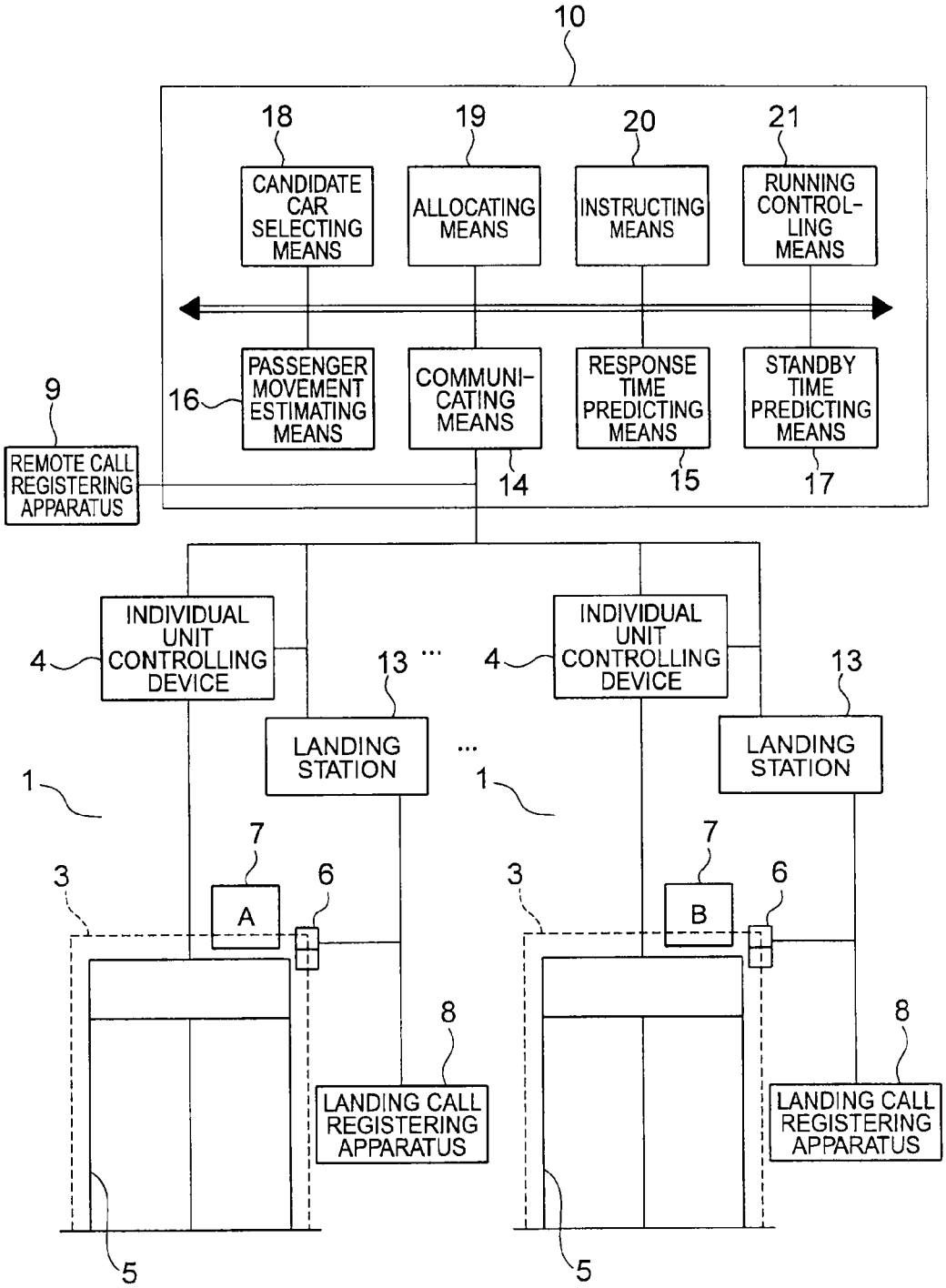
FIG. 1 is a structural diagram that shows an elevator group supervision controlling apparatus according to Embodiment 1 of the present invention.
Figure 2:
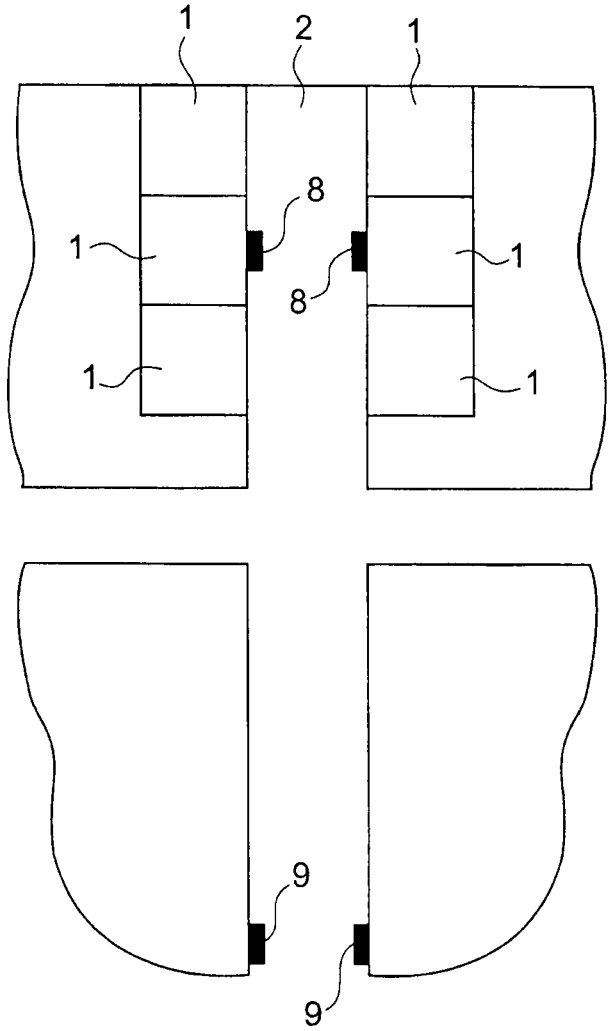
FIG. 2 is a plan that shows a building floor on which an elevator apparatus from FIG. 1 has been installed.

FIG. 1 is a structural diagram that shows an elevator group supervision controlling apparatus according to Embodiment 1 of the present invention. FIG. 2 is a plan that shows a building floor on which an elevator apparatus from FIG. 1 has been installed. In the figures, in a building in which a plurality of elevator apparatuses 1 are installed, common landings 2 in which the respective elevator apparatuses 1 are adjacent are disposed on each floor, as shown in FIG. 2. Each of the elevator apparatuses 1 has: a car 3 that can stop at the landings 2; and an individual unit controlling device 4 that controls movement of the car 3.

Elevator doorways 5 that can be opened and closed are respectively disposed between each of the elevator apparatuses 1 and the landings 2. Boarding and leaving of passengers is enabled between the landings 2 and the inside of the cars 3 when the elevator doorways 5 are open. A hall lantern 6 that shows information concerning elevator operation by lighting up or flashing, and a elevator number displaying plate 7 for displaying a mutually-different elevator number for each of the elevator apparatuses 1 (in this example, Elevator A and Elevator B) are disposed on the landings 2 for each of the elevator doorways 5. The hall lanterns 6 indicate an elevator doorway 5 at which arrival of the car 3 is scheduled by lighting, and indicate that the car 3 has arrived at the scheduled elevator doorway 5 by flashing.

Landing call registering apparatuses 8 that are disposed on the landings 2, and remote call registering apparatuses 9 that are disposed at positions that are distant from the landings 2 are disposed on the respective building floors. The landing call registering apparatuses 8 and the remote call registering apparatuses 9 generate car calls on receiving predetermined input operations. The information from both the landing call registering apparatuses 8 and the remote call registering apparatuses 9 is sent to a group supervision controlling apparatus 10. The group supervision controlling apparatus 10 controls each of the elevator apparatuses 1 as a group based on the respective information from the landing call registering apparatuses 8 and the remote call registering apparatuses 9. Consequently, control of the individual unit controlling devices 4 is managed by the group supervision controlling apparatus 10.

Figure 3:
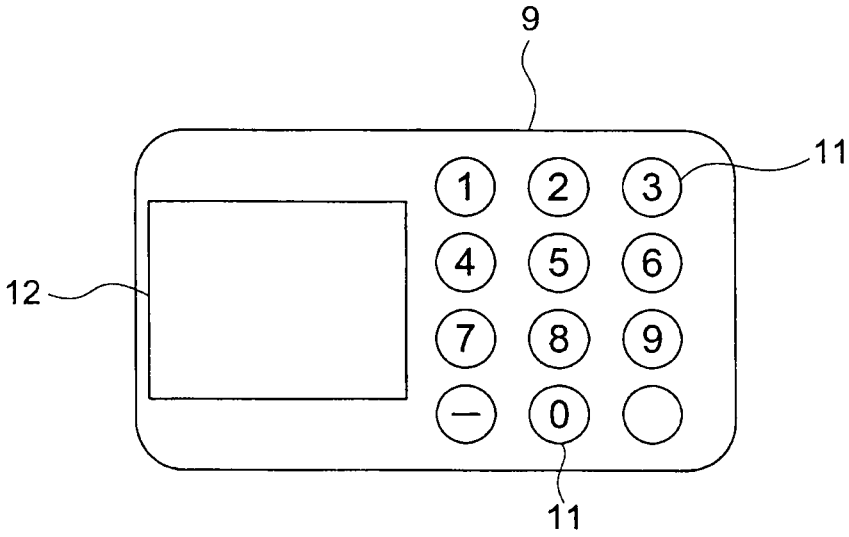
FIG. 3 is a front elevation that shows a remote call registering apparatus from FIG. 1.

Now, FIG. 3 is a front elevation that shows a remote call registering apparatus from FIG. 1. A plurality of operating buttons (numeric keypads in this example) for generating a car call 11 by performing input operations that specify a destination floor, and a displaying device (a warning device) 12 for communicating information that relates to the operation of each of the elevator apparatuses 1 are disposed on the remote call registering apparatuses 9. If the twelfth floor (12F) is to be specified as a destination floor, for example, keys "1" and "2" are pushed sequentially. The twelfth floor (12F) is thereby specified as a destination floor, and a car call is generated. Configuration of the landing call registering apparatuses 8 is also similar to that of the remote call registering apparatuses 9.

As shown in FIG. 1, operation of landing equipment that includes the hall lanterns 6 and the landing call registering apparatuses 8 is controlled by a plurality of landing stations (landing equipment controlling apparatuses) 13. Communication of information between the landing call registering apparatuses 8 and the group supervision controlling apparatus 10 is performed through the landing stations 13.

The group supervision controlling apparatus 10 has: a communicating means 14; a response time predicting means 15; a passenger movement estimating means 16; a standby time predicting means 17; a candidate car selecting means 18; an allocating means 19; an instructing means 20; and a running controlling means 21.

The communicating means 14 performs communication of information between the group supervision controlling apparatus 10 and each of the individual unit controlling devices 4, the remote call registering apparatuses 9, and the landing stations 13.

The response time predicting means 15 predicts by computation the response time for each of the cars 3 to a car call that is generated by either the landing call registering apparatuses 8 or the remote call registering apparatuses 9, respectively. Specifically, the car response time predicting means 15 predicts by computation respective time periods from when a car call is generated by at least one of the landing call registering apparatuses 8 or the remote call registering apparatuses 9 until each of the cars 3 would arrive at the landing 2 and the respective elevator doorway 5 opened (response times).

The passenger movement estimating means 16 estimates the passenger moving time from the generation of a car call at either the landing call registering apparatuses 8 or the remote call registering apparatuses 9 until the passenger reaches the landing 2. The time until the passenger reaches the landing 2 differs depending on the position of the passenger when the car call is generated. Consequently, the passenger moving time is estimated based on a positional relationship between the call registering apparatus that generated the car call, which is either a landing call registering apparatus 8 or a remote call registering apparatus 9, and the landing 2. In other words, if a landing call registering apparatus 8 generated the car call, passenger moving time is estimated based on the positional relationship between the landing call registering apparatus 8 and the landing 2, and if the remote call registering apparatuses 9 generated the car call, passenger moving time is estimated based on the positional relationship between the remote call registering apparatus 9 and the landing 2. Data concerning the respective positional relationships between the landing 2 and the landing call registering apparatus 8 and between the landing 2 and the remote call registering apparatus 9 is preset in the group supervision controlling apparatus 10.

For example, if the distance from a remote call registering apparatuses 9 to the landing 2 is X (m), and the moving speed of a passenger is 1.1 (m/s), then the passenger moving time T (s) when the remote call registering apparatus 9 has generated a car call can be found using Expression (1).

$$T=X/1.1 \quad (1)$$

Because the landing call registering apparatuses 8 are disposed at the landings 2, the passenger moving time T when a landing call registering apparatus 8 has generated the car call can be assumed to be zero, for example.

Moreover, passenger moving times corresponding to the landing call registering apparatus 8 and the remote call registering apparatus 9, respectively, may also be calculated in advance, and the calculated results stored in the group supervision controlling apparatus 10 as parameters for later use.

The standby time predicting means 17 compares the passenger moving time with the response time of each of the cars 3 based on respective information from the response time predicting means 15 and the passenger movement estimating means 16, and predicts by computation the respective standby times for each of the cars 3 that each of the cars 3 will wait at the landing 2. If the response time of the car 3 is longer than the passenger moving time, it is assumed that standby time with the door open is not required, and the standby time of the car 3 assumed to be zero. If the response time of the car 3 is less than or equal to the passenger moving time, then the time difference between the passenger moving time and the response time of the car 3 is considered to be the standby time of the car 3.

The candidate car selecting means 18 determines whether or not to include each of the cars 3 in candidate cars based on information from the standby time predicting means 17. Specifically, the candidate car selecting means 18 includes any car 3 for which the standby time is shorter than an predetermined upper limit (such as 30 seconds, for example) in the candidate cars, and excludes any car 3 for which the standby time is greater than or equal to the predetermined upper limit from the candidate cars. Consequently, cars 3 for which standby time is determined to be zero by the standby time predicting means 17 are all included in the candidate cars. If all of the standby times of the cars 3 are longer than the upper limit, then all of the cars 3 are excluded from the candidate cars.

The allocating means 19 allocates a car 3 as an allocated car to respond to the car call from among the candidate cars that have been selected by the candidate car selecting means 18. Specifically, the allocating means 19 decides which car to allocate if at least one of the cars 3 has been included in the candidate cars. A decision on the allocated car is not performed by the allocating means 19 if all of the cars 3 have been excluded from the candidate cars.

The decision on the allocated car is made by finding an integrated evaluation value for each of the candidate cars, and designating the candidate car for which the integrated evaluation value is highest as the allocated car, for example. The integrated evaluation value can be found by performing weighting on each evaluation value that is found by computation that corresponds to each of the evaluation items for a plurality of types of evaluation items, and totaling the respective weighted evaluation values. In other words, the integrated evaluation value J(I) when a car 3 that has an elevator number I is being considered as an allocated car can be found using Expression (2).

$$J(I)=\Sigma w_i \times f_i(x_i) \tag{2}$$

Here, $w_i$ are weight values (weights), and $f_i(x_i)$ are evaluation values of various kinds of evaluation items.

Examples of the various kinds of evaluation items include, for example, passenger waiting time at the landing 2, standby time of the car 3 at the landing 2, etc.

The instructing means 20 generates an informing instruction that communicates reinput requesting information to the remote call registering apparatus 9 that recommends an input operation at the landing call registering apparatus 8 if all of the cars 3 have been excluded from being candidate cars. If an allocated car has been decided by the allocating means 19, the instructing means 20 generates an informing instruction that communicates to the remote call registering apparatus 9 allocating information that specifies the allocated car. The informing instruction that is generated by the instructing means 20 is sent to the remote call registering apparatus 9. If an allocated car has been decided, an allocating information informing instruction is also sent from the instructing means 20 to the landing call registering apparatus 8.

In other words, the group supervision controlling apparatus 10 predicts respective standby times of each of the cars 3 by comparing the response time of each of the cars 3 relative to a car call from a remote call registering apparatus 9 and passenger moving time that is found based on the positional relationship between the remote call registering apparatus 9 and the landing 2, and generates an informing instruction that communicates reinput requesting information to the remote call registering apparatus 9 if the standby times of all of the cars 3 are greater than or equal to a predetermined time interval.

The remote call registering apparatuses 9 display reinput requesting information on the displaying device 12 on receiving a reinput requesting information informing instruction, and display allocating information on the displaying device 12 on receiving an allocating information informing instruction. The landing call registering apparatus 8 displays allocating information on the displaying device 12 on receiving an allocating information informing instruction.

Figure 4:
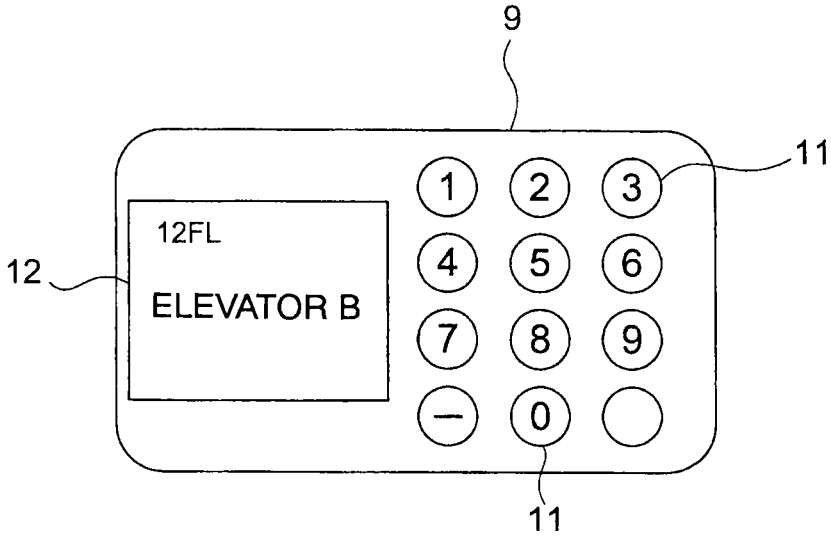
FIG. 4 is a front elevation that shows the remote call registering apparatus when allocating information is displayed by a displaying device from FIG. 3.
Figure 5:
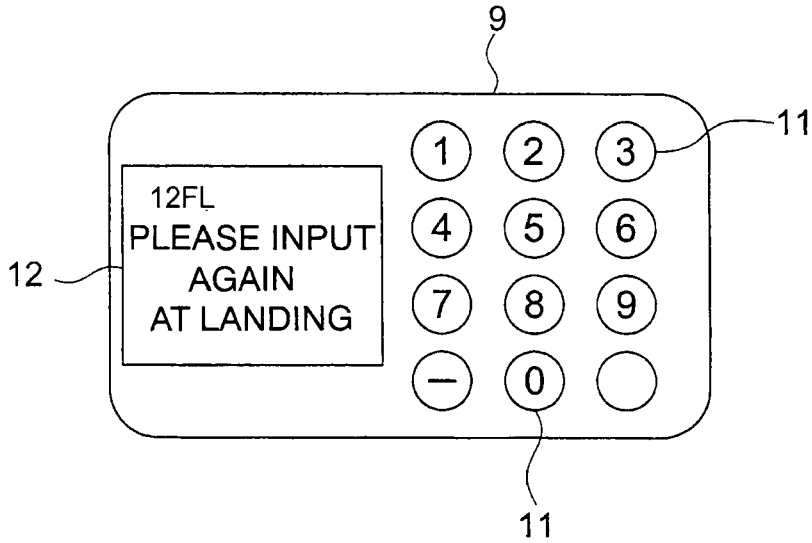
FIG. 5 is a front elevation that shows the remote call registering apparatus when reinput requesting information is displayed by the displaying device from FIG. 3.

Now, FIG. 4 is a front elevation that shows a remote call registering apparatus 9 when allocating information is displayed by a displaying device 12 from FIG. 3, and FIG. 5 is a front elevation that shows the remote call registering apparatus 9 when reinput requesting information is displayed by the displaying device 12 from FIG. 3. If the remote call registering apparatus 9 has received an allocating information informing instruction, the name of the elevator that has the allocated car (such as Elevator B, for example), and the floor name of the destination floor of the car 3 that has been specified in the input operation (such as the twelfth floor (12F), for example) are displayed by the displaying device 12 of the remote call registering apparatus 9 as allocating information, as shown in FIG. 4. If the remote call registering apparatus 9 has received a reinput requesting information informing instruction, content such as "Please input again at landing", for example, (reinput requesting information) is displayed by the displaying device 12 of the remote call registering apparatus 9, as shown in FIG. 5.

The running controlling means 21 supervises and controls running of each of the elevator apparatuses 1 based on allocated car information that has been decided by the allocating means 19.

Figure 6:
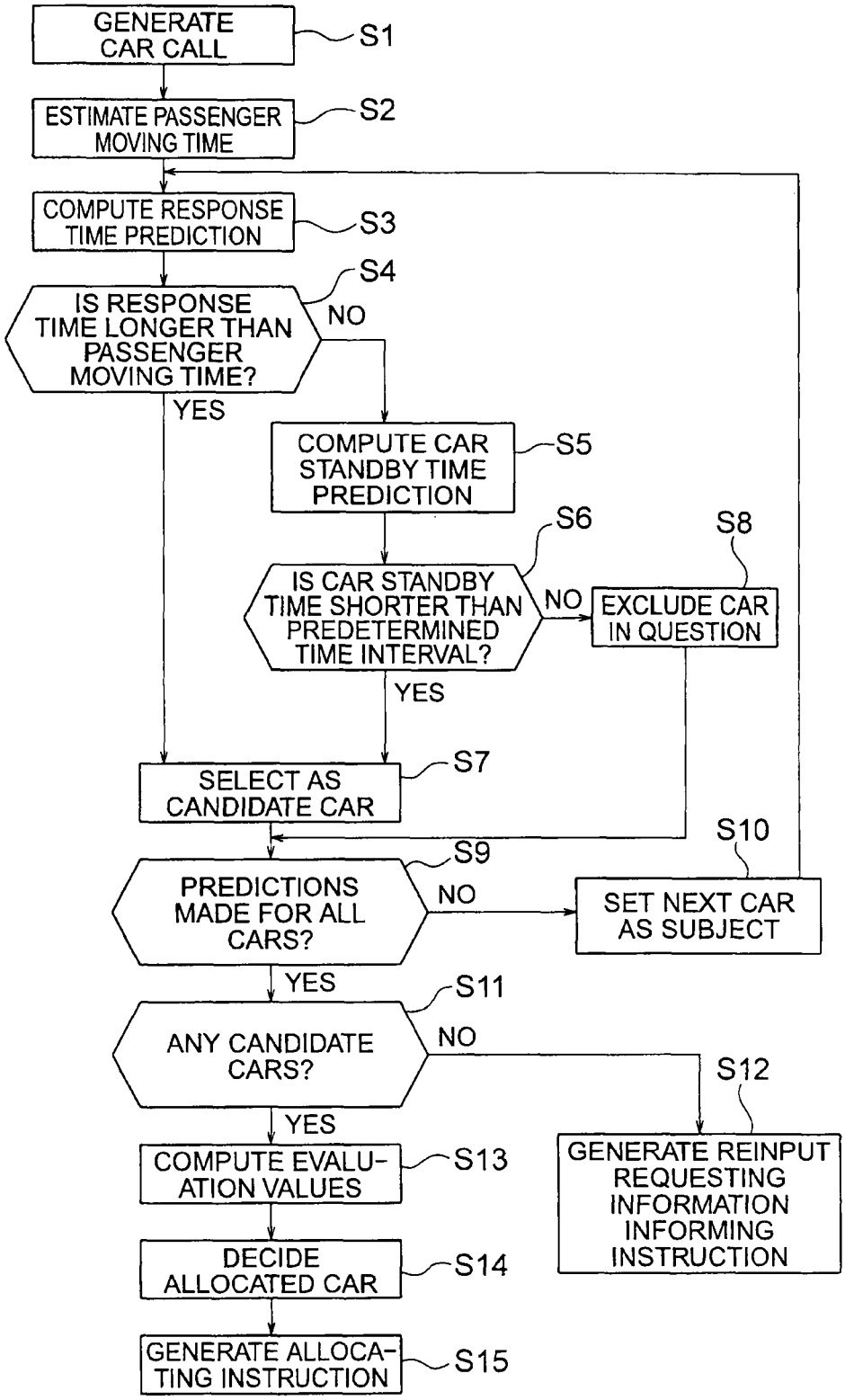
FIG. 6 is a flowchart that explains processing operations of the elevator group supervision controlling apparatus from FIG. 1.

Next, operation will be explained. FIG. 6 is a flowchart that explains processing operations of the elevator group supervision controlling apparatus 10 from FIG. 1. When a car call is generated by predetermined input operations being performed on either a landing call registering apparatus 8 or a remote call registering apparatus 9 (S1), car call information is sent to the group supervision controlling apparatus 10. Passenger moving time for the passenger to reach the landing 2 is then estimated by the passenger movement estimating means 16 based on the position of the call registering apparatus at which the car call was generated (S2).

Response time of the cars 3 to the car call is then predicted by computation by the response time predicting means 15 (S3).

The passenger moving time is then compared with the response time of the cars 3 by the standby time predicting means 17, which decides whether or not the response time of the cars 3 is longer than the passenger moving time (S4).

If the response time of a car 3 is less than or equal to the passenger moving time, that is, if the car 3 will arrive at the landing 2 before the passenger moving time has elapsed, the standby time of the car 3 at the landing 2 is predicted by computation in the standby time predicting means 17 by deducting the response time of the car 3 from the passenger moving time (S5).

The candidate car selecting means 18 then determines whether or not the standby time of the car 3 is shorter than a predetermined upper limit standby time (predetermined time interval) (S6).

If the response time of the car 3 is longer than the passenger moving time, or if the standby time of the car 3 is shorter than the upper limit standby time even if the response time of the car 3 is less than or equal to the passenger moving time, then the car 3 in question is included in candidate cars by the candidate car selecting means 18 (S7).

If the standby time of the car 3 is greater than or equal to the upper limit standby time, the car 3 in question is excluded from the candidate cars by the candidate car selecting means 18 (S8).

It is then determined whether or not the above computational processing (S3 through S8) has been completed for all of the cars 3 (S9). If the computational processing has not been completed for all of the cars 3, the subject of the computational processing is moved to the next unprocessed car 3 (S10), and the above computational processing (S3 through S8) is performed again. The computational processing (S3 through S8) is thereby performed for all of the cars 3, and selection as to whether or not to be included in the candidate cars is performed for each of the cars 3.

When the computational processing (S3 through S8) has been completed for each of the cars 3, it is determined whether or not a candidate car has been chosen from among the cars 3 (S11).

If all of the cars 3 have been excluded from the candidate cars, an informing instruction that includes reinput requesting information is sent from the instructing means 20 to the remote call registering apparatus 9 (S12). Content that recommends an input operation at the landing call registering apparatus 8 is thereby displayed on the displaying device 12 of the remote call registering apparatus 9 (FIG. 5).

If at least one of the cars 3 has been included in the candidate cars, then evaluation values for various kinds of evaluation items are found by computation by the allocating means 19 for each of the candidate cars (S13).

An integrated evaluation value J(I) is then found in the allocating means 19 for each of the candidate cars by substituting the evaluation values that have been found for the various kinds of evaluation items into Expression (2). The respective integrated evaluation values J(I) of the candidate cars are then compared, and the candidate car that has the highest evaluation is decided as the allocated car (S14).

When the allocated car is decided by the allocating means 19, an allocating instruction is then output from the running controlling means 21 to the elevator apparatus 1 that has the allocated car (S15). The allocated car thereby responds to the car call, and the allocated car is moved to the landing 2 of the floor on which the car call was generated.

When the allocated car is decided by the allocating means 19, an informing instruction that includes the allocating information is sent from the instructing means 20 to both the landing call registering apparatus 8 and the remote call registering apparatus 9. Content that identifies the elevator number that has the allocated car is thereby displayed on the respective displaying devices 12 of the landing call registering apparatus 8 and the remote call registering apparatus 9 (FIG. 4).

In an elevator group supervision controlling apparatus of this kind, because reinput requesting information that recommends an input operation at a landing call registering apparatus 8 is communicated to a remote call registering apparatus 9 if standby times of all cars 3 are greater than or equal to a predetermined upper limit and all of the cars 3 have been excluded from candidate cars, designating cars 3 that are predicted to have long standby times as allocated cars can be avoided, enabling the standby time of the cars 3 to be prevented from being significantly extended. Consequently, improvements in transporting efficiency of each of the elevator apparatuses 1 can be achieved. Because the passengers can perform the input operation at the landing call registering apparatus 8, the passengers can be prevented from missing the car 3.

Because the reinput requesting information is displayed by the displaying device 12 of the remote call registering apparatus 9, the reinput requesting information can be conveyed to the passengers more reliably.

Moreover, in the above example, the reinput requesting information is announced by a display, but speakers (announcing devices) may also be disposed on the remote call registering apparatuses 9 so as to announce the reinput requesting information by voice.

In the above example, the landing call registering apparatus 8 and the remote call registering apparatus 9 generate a car call by operation of buttons but are not limited in this, and for example, the landing call registering apparatus 8 and the remote call registering apparatus 9 may also be made a card reader or a security gate, etc., so as to generate a car call by an operation of reading personal information.

What is claimed is:

1. An elevator group supervision controlling apparatus that supervises a plurality of elevator apparatuses as a group based on respective information from: a landing call registering apparatus that is disposed on a landing; and a remote call registering apparatus that is disposed at a position that is distant from the landing, the elevator group supervision controlling apparatus being comprising:

a response time predicting means that predicts respective response times for cars of each of the elevator apparatuses to a car call that the remote call registering apparatus generates on receiving a predetermined input operation;

a passenger movement estimating means that estimates passenger moving time for a passenger to reach the landing from the remote call registering apparatus based on a positional relationship between the remote call registering apparatus and the landing;

a standby time predicting means that predicts respective standby times at the landing for each of the cars based on the response times and the passenger moving time;

a candidate car selecting means that includes a car for which the standby time is shorter than a predetermined time interval in candidate cars, and excludes a car for which the standby time is greater than or equal to the predetermined time interval from the candidate cars;

an allocating means that decides a car from among the candidate cars as an allocated car that responds to the car call if at least one of the cars has been included in the candidate cars; and an instructing means that generates an informing instruction that communicates to the remote call registering apparatus reinput requesting information that recommends an input operation at the landing call registering apparatus if all of the cars have been excluded from the candidate cars.

2. An elevator group supervision controlling apparatus that supervises a plurality of elevator apparatuses as a group based on respective information from: a landing call registering apparatus that is disposed on a landing; and a remote call registering apparatus that is disposed at a position that is distant from the landing, the elevator group supervision controlling apparatus:

predicting respective standby times of cars by comparing:

a response time of each car of the elevator apparatuses to a car call from the remote call registering apparatus; and a passenger moving time that is found based on a positional relationship between the remote call registering apparatus and the landing, and generating an informing instruction that communicates to the remote call registering apparatus reinput requesting information that recommends an input operation at the landing call registering apparatus if the standby times of all of the car are greater than or equal to a predetermined time interval.

3. An elevator group supervision controlling apparatus according to claim 1, wherein the reinput requesting information is displayed by the remote call registering apparatus.

4. An elevator group supervision controlling apparatus according to claim 2, wherein the reinput requesting information is displayed by the remote call registering apparatus.

* * * * *